US009131757B2

(12) United States Patent
Tseng

(10) Patent No.: US 9,131,757 B2
(45) Date of Patent: Sep. 15, 2015

(54) PACKAGING AND DISPLAY BOX FOR ELECTRONIC DEVICE

(71) Applicant: FIH (Hong Kong) Limited, Kowloon (HK)

(72) Inventor: Chien-Feng Tseng, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 14/183,387

(22) Filed: Feb. 18, 2014

(65) Prior Publication Data

US 2015/0034527 A1 Feb. 5, 2015

(30) Foreign Application Priority Data

Aug. 2, 2013 (TW) ..... 102127706 U

(51) Int. Cl.

| | |
|---|---|
| ***A45C 11/00*** | (2006.01) |
| ***B65D 5/50*** | (2006.01) |
| ***B65D 5/52*** | (2006.01) |
| *B65D 81/02* | (2006.01) |
| *B65D 5/42* | (2006.01) |
| *B65D 5/66* | (2006.01) |

(52) U.S. Cl.

CPC ..... *A45C 11/00* (2013.01); *B65D 5/503* (2013.01); *B65D 5/5023* (2013.01); *B65D 5/5273* (2013.01); *A45C 2011/002* (2013.01); *B65D 5/4295* (2013.01); *B65D 5/66* (2013.01); *B65D 81/025* (2013.01); *B65D 2585/6835* (2013.01)

(58) Field of Classification Search

CPC ..... A45C 11/00; A45C 2011/002; B65D 5/5019; B65D 5/5206; B65D 5/5213; B65D 5/5253; B65D 5/5273; B65D 43/162–43/165; B65D 81/025; B65D 81/113

USPC ..... 220/4.22, 4.23, 4.24; 206/45.2, 206/45.23–45.26, 320, 590–592, 701, 722, 206/736, 747, 749, 755, 757, 762, 774, 776

See application file for complete search history.

(56) References Cited

U.S. PATENT DOCUMENTS

| | | | | |
|---|---|---|---|---|
| 3,813,025 | A * | 5/1974 | Solomon | 220/4.23 |
| 5,107,985 | A * | 4/1992 | Bezrutczyk et al. | 206/757 |
| 5,615,765 | A * | 4/1997 | Roericht | 206/45.23 |
| 7,318,521 | B2 * | 1/2008 | Lau | 206/45.24 |
| 7,780,010 | B2 * | 8/2010 | Kinuhata | 206/722 |
| 2012/0048757 | A1 * | 3/2012 | Ohsawa et al. | 206/320 |
| 2013/0098789 | A1 * | 4/2013 | Jun et al. | 206/320 |

FOREIGN PATENT DOCUMENTS

| | | | |
|---|---|---|---|
| GB | 2421722 A | * | 7/2006 |
| KR | 10-1292295 B1 | * | 7/2013 |

* cited by examiner

*Primary Examiner* — Bryon Gehman

(74) *Attorney, Agent, or Firm* — Novak Druce Connolly Bove + Quigg LLP

(57) ABSTRACT

A packaging box includes a first case. The first case includes a bottom wall, a first side wall, and a mounting wall. The mounting wall includes a receiving chamber configured to receive an electronic device. The bottom wall, the first side wall, and mounting wall are connected to each other. The mounting wall is supported by the bottom wall and the first side wall and forms an acute angle with the bottom wall.

20 Claims, 7 Drawing Sheets

PACKAGING AND DISPLAY BOX FOR ELECTRONIC DEVICE

BACKGROUND

1. Technical Field

The disclosure generally relates to packaging boxes, and particularly to a packaging box for electronic devices.

2. Description of Related Art

To prevent fragile precision electronic devices such as mobile phones from being damaged during transportation (e.g. by water, dust and impact), the electronic devices are commonly put in boxes before shipment. However, most of the boxes are commonly discarded after users buy the devices and remove the device from the box, which can be a waste of resources.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
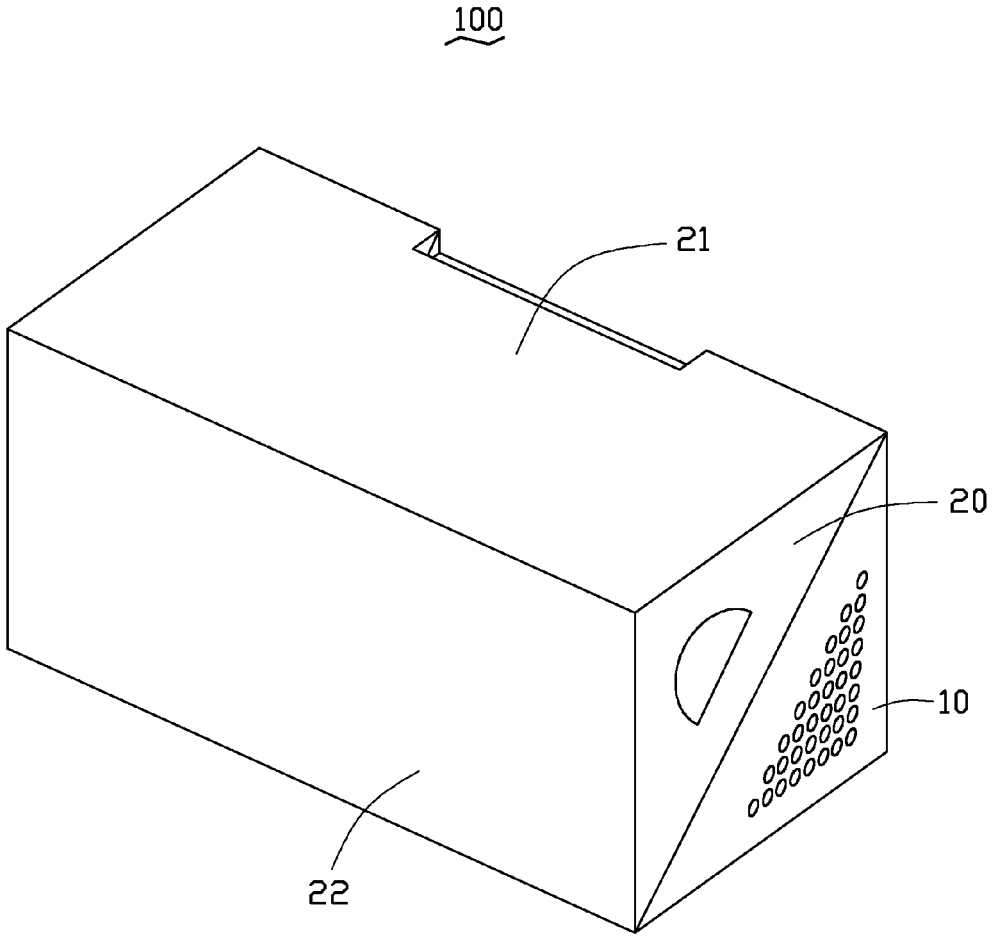
FIG. 1 is a schematic view of a packaging box, according to an exemplary embodiment of the disclosure.
Figure 5:
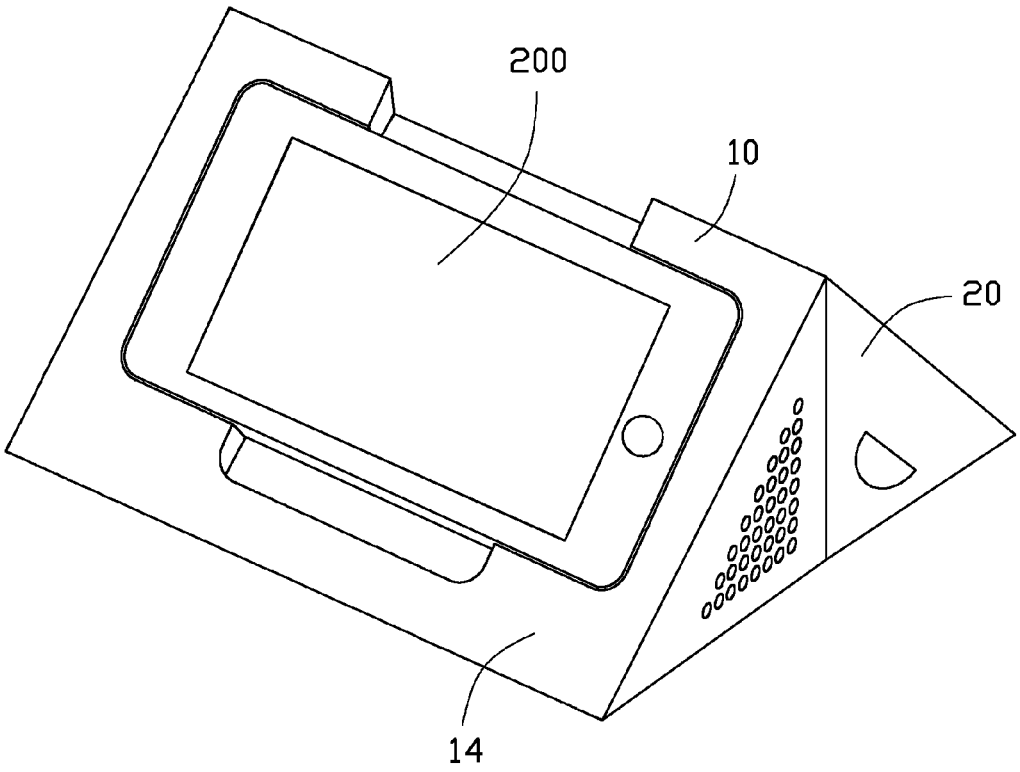
FIG. 5 is a schematic view of the packaging box of FIG. 4 when an electronic device is received in the packaging box at a first position.
Figure 6:
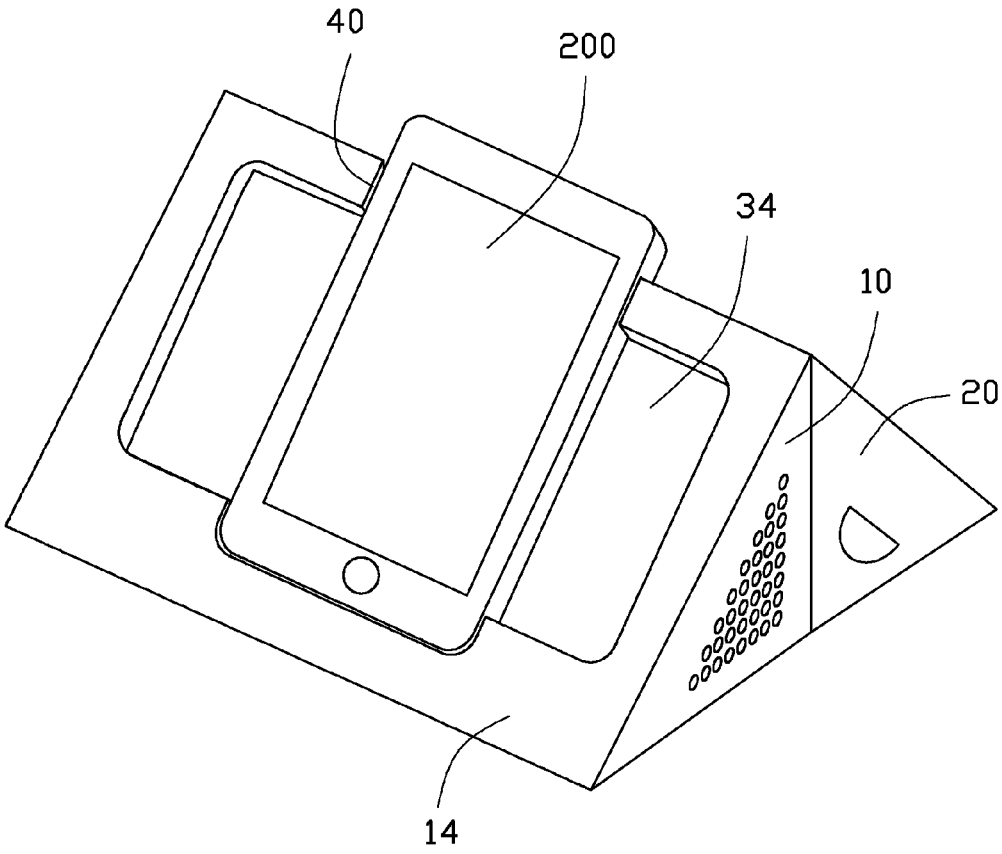
FIG. 6 is similar to FIG. 5, but showing the packaging box when the electronic device is received in the packaging box at a second position.

FIG. 1 is a schematic view of a packaging box 100, according to an exemplary embodiment of the disclosure. The packaging box 100 is used to accommodate an electronic device 200 (shown in FIG. 5) and accessories (e.g. an earphone, a charger, a data cable, and a owners manual) when packaged and also configured to provide a better viewing angle for the user when used for viewing videos (as shown in FIGS. 5 and 6). The packaging box 100 includes a box and a supporter 30 received in the box. In this embodiment, the box includes a first case 10 and a second case 20 rotatably connected to the first case 10. The supporter 30 is configured to support the electronic device 200 and is received in the second case 20. The second case 20 is covering the first case 10 packaging the supporter 30 in the box. The accessories can be received in the second case 20. In this embodiment, the packaging box 100 can be made of hardboard or plastic board.

Figure 2:
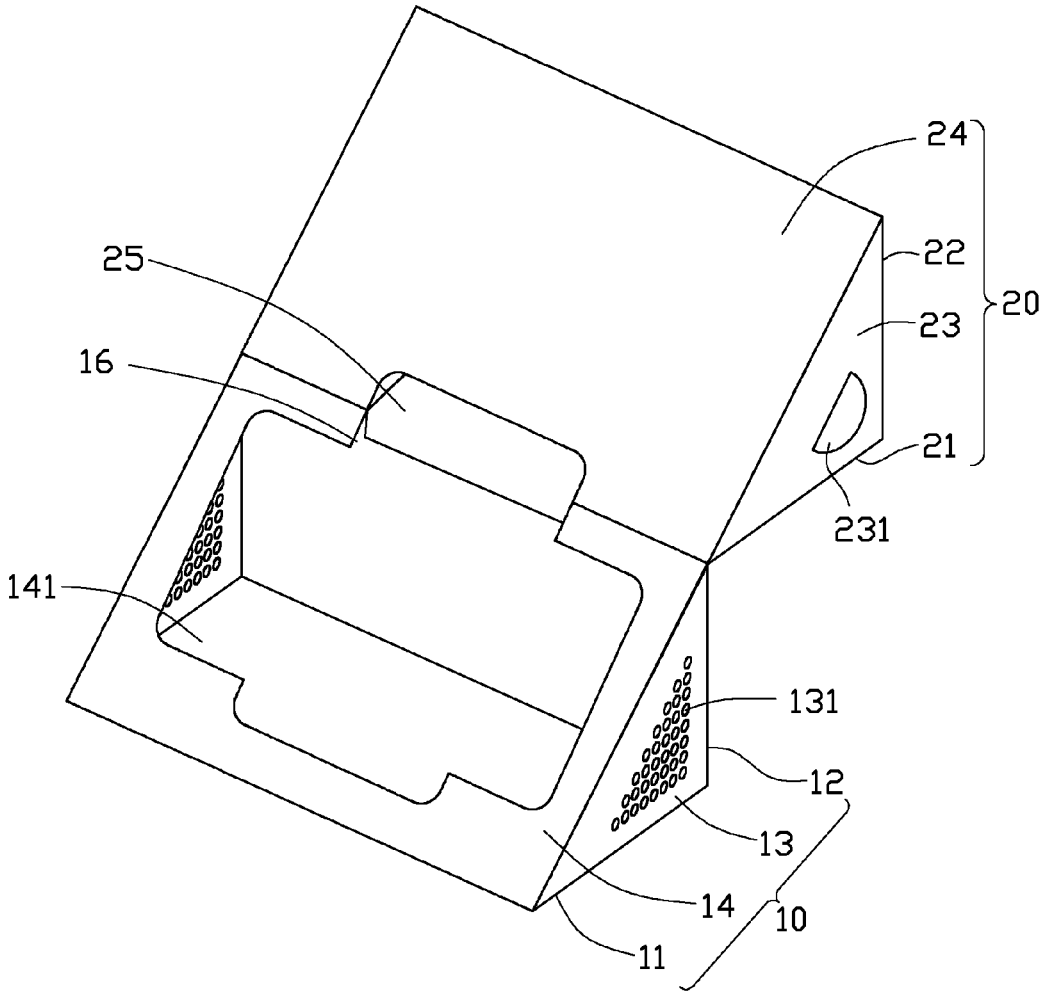
FIG. 2 is similar to FIG. 1, but showing the packaging box in an open state.

FIG. 2 shows the packaging box 100 in an open state. The first case 10 is substantially a hollow triangular prism. In this embodiment, a shape of a cross-section of the first case 10 is substantially an isosceles triangle. The first case 10 includes a bottom wall 11, a first side wall 12, a mounting wall 14, and two first end walls 13. The bottom wall 11, the first side wall 12, and the mounting wall 14 are substantially parallelograms. The bottom wall 11, the first side wall 12 and the mounting wall 14 are connected to each other to form the triangular prism of the first case 10 so that the mounting wall 14 is supported by the bottom wall 11 and the first side wall 12 and forms an acute angle with the bottom wall 11. A substantially cross-shaped mounting opening 141 is defined in the mounting wall 14 to receive the supporter 30. A first cut 16 is defined in the mounting wall 14 adjacent to an edge between the mounting wall 14 and the first side wall 12. The first cut 16 communicates with the mounting opening 141. Each first end wall 13 is substantially an isosceles triangle and defines a plurality of sound holes 131. The first end walls 13 are respectively connected two ends of the triangular prism formed by the bottom wall 11, the first side wall 12, and the mounting wall 14 to enclosure the first case 10.

Figure 7:
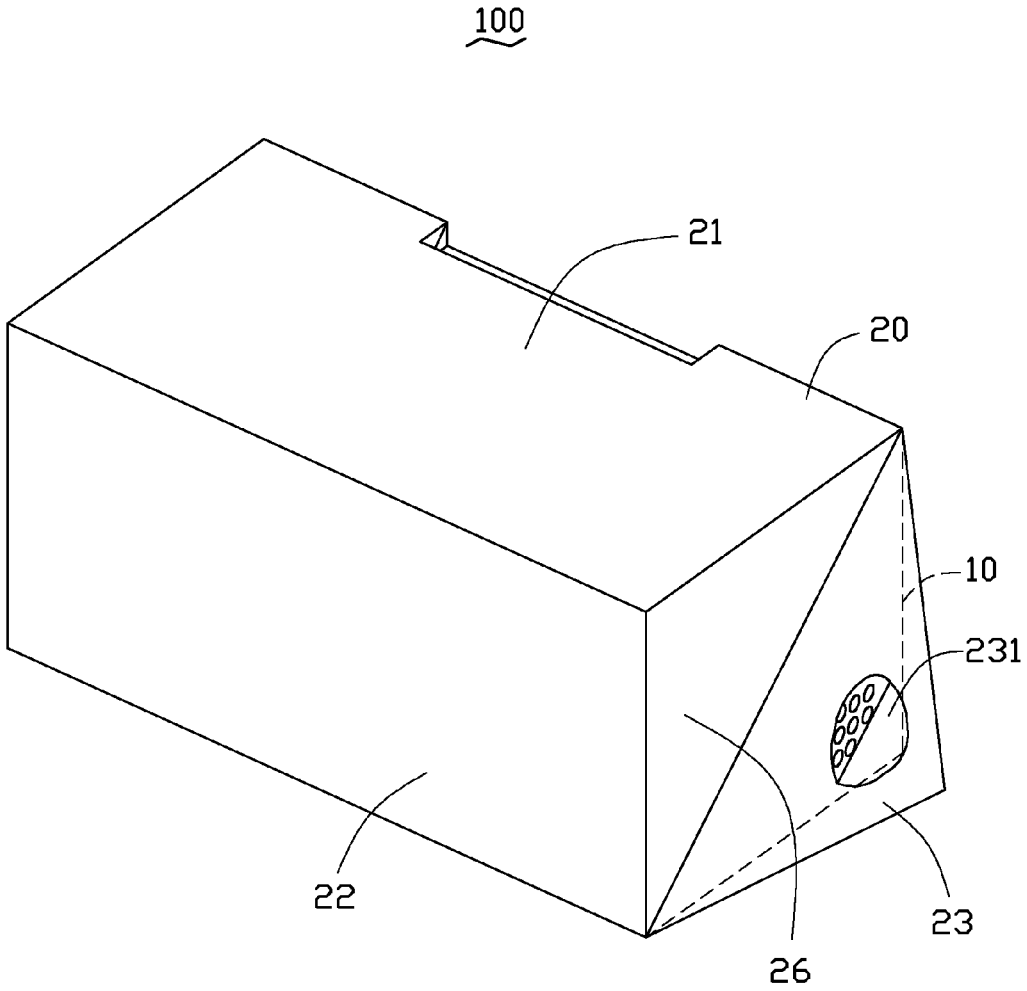
FIG. 7 is similar to FIG. 1, but showing the packaging box when a second end wall is opened.

The second case 20 is substantially a hollow triangular prism similar to the first case 10 and includes a top wall 21, a second side wall 22, a separating wall 24, and two second end walls 23. The top wall 21, the second side wall 22, and the separating board 24 are connected to each other to form the triangular prism of the second case 20. A receiving space 26 (as shown in FIG. 7) is formed by the top wall 21, the second side wall 22, and the separating wall 24 to receive the accessories. A second cut 25 is defined in the separating wall 24 adjacent to an edge between the separating wall 24 and the top wall 21 and corresponding to the first cut 16. Each second end wall 23 is substantially an isosceles triangle corresponding to two ends of the triangular prism formed by the top wall 21, the second side wall 22, and the separating wall 24. One edge of each end wall 23 corresponding to the separating wall 24 is rotatably connected to an end of the separating board 24. Other two edges of each end wall 23 corresponding to the top wall 21 and the second side wall 22 are separated from the top wall 21 and the second side wall 22. Thus, the two second end walls 23 can be rotated relative to the separating board 24 to open or close the receiving space 26. A substantial semicircular movable board 231 is formed by cutting a portion of each second end wall 23. The movable board 231 is rotatably connected to the second end wall 23 and configured for the user to conveniently open or close the second end walls 23.

Figure 3:
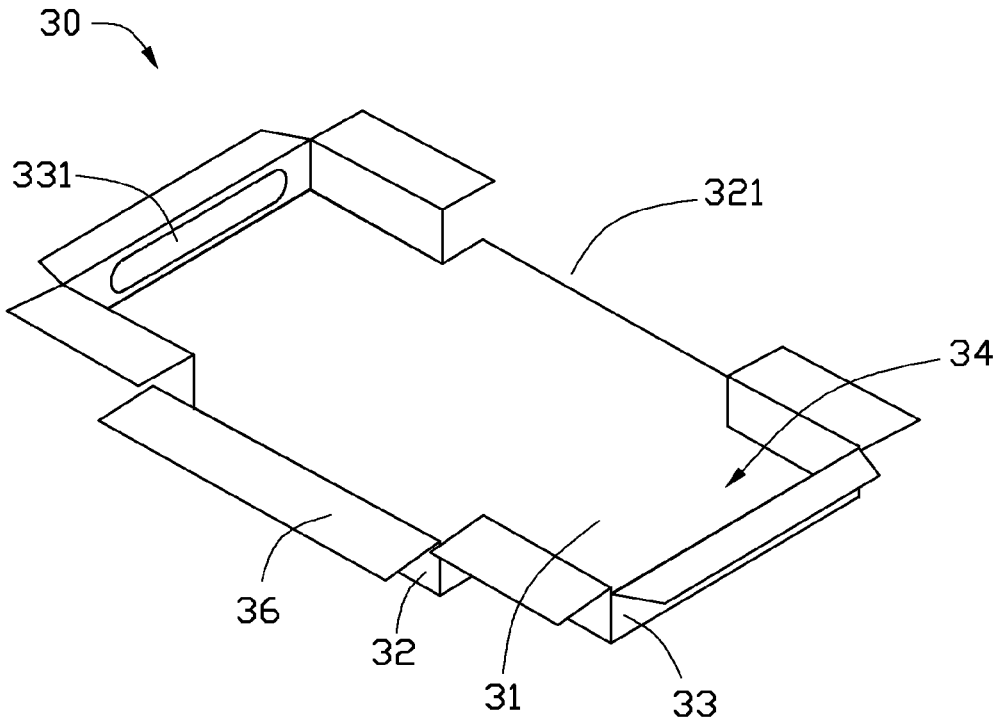
FIG. 3 is a schematic view of a supporter of the packaging box of FIG. 1.

FIG. 3 shows that, the supporter 30 includes a bottom board 31, a side board 32, and two opposite end portions 33. The bottom board 31 is substantially a cross-shaped board corresponding to the mounting opening 141. The side board 32 is substantially a rectangular board. Each end portion 33 is substantially U-shaped board and defines a through hole 331. The side board 32 and the end portions 33 surround edges of the bottom board 31 to form a receiving chamber 34 with a third cut 321. The supporter 30 further includes a plurality of fixing boards 36 perpendicularly extending from ends of the side board 32 and the two end portions 33 opposite to the bottom board 31 along a direction away from the receiving chamber 34.

In assembly, the second case 20 is rotatably connected to the first case 10 by interconnecting the edge between the separating wall 24 and the top wall 21 and the edge between the mounting wall 14 and the first side wall 12. The first cut 16 is aligned with the second cut 25 (as shown in FIG. 2). The supporter 30 is received in the mounting opening 141 with the third cut 321 aligning with the first cut 16. The third cut 321 and the first cut 16 form a latching slot 40 (as shown in 4). The fixing boards 36 are fixed to an inner surface of the mounting wall 14. A sound chamber (not labeled) is formed between the supporter 30 and the first case 10 communicating with the sound holes 131 and the through holes 331.

To package the electronic device 200 in the package box 100, the electronic device 200 is received in the receiving chamber 34 at a first position (i.e. a horizontal as shown in FIG. 5). The second case 20 is rotated to cover the first case 10 with the separating board 24 attaching to the mounting board 14.

Figure 4:
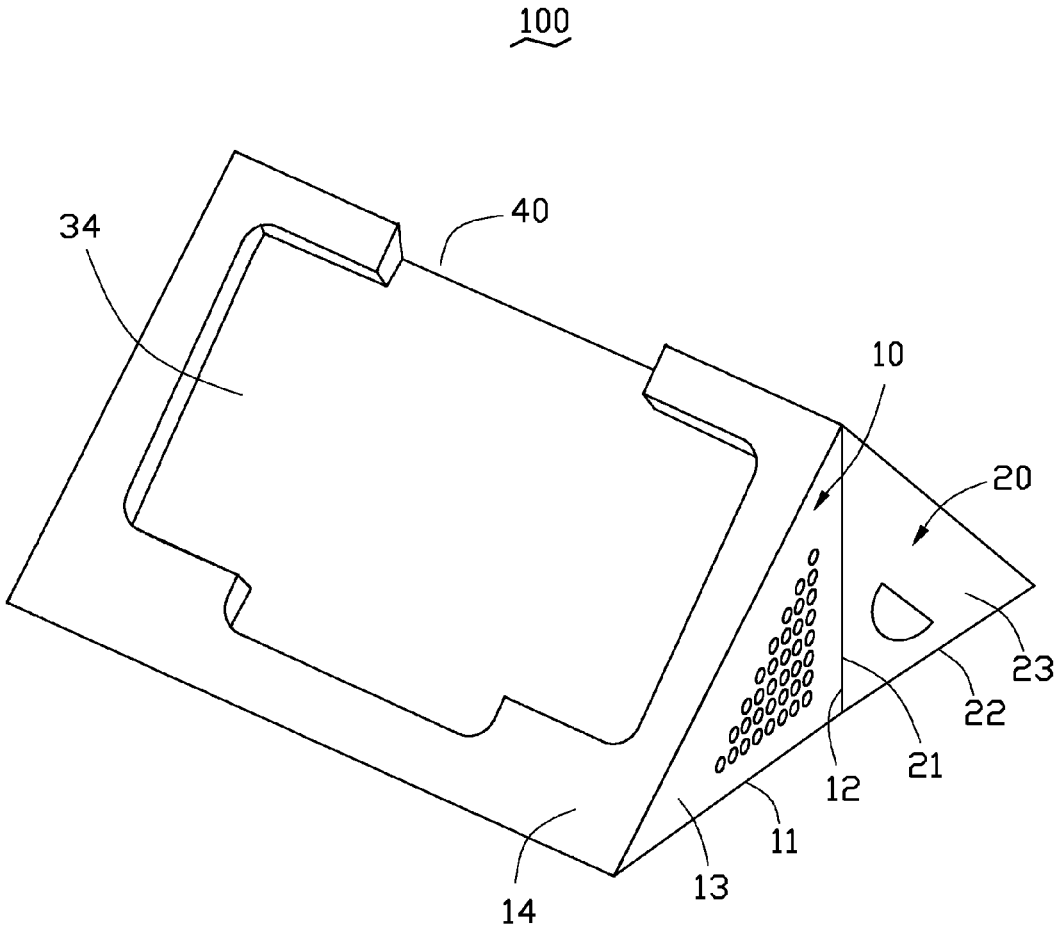
FIG. 4 is similar to FIG. 2, but showing the packaging box in a use state.

FIG. 4 shows the packaging box 100 with the electronic device 200 being used to view videos. The second case 20 is rotated relative the first case 10 exposing the first case 10. The electronic device 200 is received in the receiving chamber 34 and can provide a better viewing angle. In addition, speakers of the electronic device 200 can be aligned with the through holes 331. Sound can be input to the sound chamber from the through holes 331 and output from the sound holes 131. Therefore, the supporter 30 will not negatively influence the sound from the electronic device 200. FIG. 6 shows the electronic device 200 in a second embodiment, received in the receiving chamber 34 in a second position (i.e. a vertical position) and latched by the latching slot 40. The electronic device 200 can be easily removed from the latching slot 40 via the second cut 25.

In other embodiments, the first end walls 13 and the second end walls 23 can be isosceles right triangles. The top wall 21 abuts against the first side wall 12 when the second case 20 is opened relative to the first case 10 so that the first case 10 can be supported by the second case 20. Furthermore, the first side wall 12 and the top wall 21 can be magnetic and attracted to each other so that the first case 10 can be more stably supported by the second case 20.

Therefore, the supporter 30 can be reused by the user which is eco-friendly. In addition, the supporter 30 has a relative simple structure and also is convenient for use.

In other embodiments, the supporter 30 can be omitted. The receiving chamber 34 can be directly formed in the mounting wall 14.

The second case 20 can be a plate rotatably connected to the first case 10 to open and close the first case 10 and the accessories can be received in the sound chamber.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A packaging box, comprising:

a first case comprising a bottom wall, a first side wall, and a mounting wall, the mounting wall comprising a substantially cross-shaped receiving chamber configured to receive an electronic device, the electronic device capable of being received in the receiving chamber in a horizontal position or a vertical position; wherein the bottom wall, the first side wall, and mounting wall are connected to each other; the mounting wall is supported by the bottom wall and the first side wall and forms an acute angle with the bottom wall.

2. The packaging box of claim 1, wherein the receiving chamber defines a latching slot at one side of the receiving chamber, when the electronic device is received in the receiving chamber at the vertical position, the electronic device is latched by the latching slot.

3. The packaging box of claim 1, wherein the first case further comprises a sound chamber, the receiving chamber defines at least one through hole, the first case further comprises two first end walls connected to two ends of the bottom wall, the first side wall, and mounting wall, each of the two first end walls defines a plurality of sound holes; sound output from the electronic device is input to the sound chamber by the at least one through hole and output from the sound holes.

4. The packaging box of claim 1, further comprising a supporter, wherein the mounting wall defines a mounting opening, the supporter comprises a bottom board corresponding to the mounting opening, a side board, and two opposite end portions, the side board and the end portions surround edges of the bottom board to form the receiving chamber.

5. The packaging box of claim 4, wherein the supporter further comprises a plurality of fixing boards perpendicularly extending from ends of the side board and the two end portions opposite to the bottom board along a direction away from the receiving chamber, the fixing boards are fixed to an inner surface of the mounting wall.

6. The packaging box of claim 1, further comprising a second case rotatably connected to the first case to open and close the first case; the second case abuts against the first case when the second case is opened relative to the first case.

7. The packaging box of claim 6, wherein the second case comprises a top wall, a second side wall, and a separating wall, every two of the bottom wall, the first side wall, and mounting wall are connected to each other, an edge between the top wall and the separating wall is rotatably connected to an edge between the mounting wall and the first side wall, the top wall abuts against the first side wall when the second case is opened relative to the first case.

8. The packaging box of claim 1, wherein the top wall and the first side wall are magnetic and attracted to each other.

9. A packaging box, comprising:

a first case comprising a bottom wall, a first side wall, and a mounting wall; and a second case rotatably connected to the first case to open and close the first case; wherein the bottom wall, the first side wall, and the mounting wall are connected to each other; the mounting wall is supported by the bottom wall and inclined relative to the bottom wall, the mounting wall comprises a substantially cross-shaped receiving chamber configured to receive an electronic device, the electronic device is capable of being received in the receiving chamber in a horizontal position or a vertical position, the second case abuts against the first case when the electronic device is received in the first case.

10. The packaging box of claim 9, wherein the receiving chamber defines a latching slot at one side of the receiving chamber, when the electronic device is received in the receiving chamber at the vertical position, the electronic device is latched by the latching slot.

11. The packaging box of claim 9, wherein the first case further comprises a sound chamber, the receiving chamber defines at least one through hole, the first case further comprises two first end walls connected to two ends of the bottom wall, the first side wall, and mounting wall, each of the two first end walls defines a plurality of sound holes; sound output from the electronic device is input to the sound chamber by the at least one through hole and output from the sound holes.

12. The packaging box of claim 9, further comprising a supporter, wherein the mounting wall defines a mounting opening, the supporter comprises a bottom board corresponding to the mounting opening, a side board, and two opposite end portions, the side board and the end portions surround edges of the bottom board to form the receiving chamber.

13. The packaging box of claim 12, wherein the supporter further comprises a plurality of fixing boards perpendicularly extending from ends of the side board and the two end portions opposite to the bottom board along a direction away from the receiving chamber, the fixing boards are fixed to an inner surface of the mounting wall.

14. The packaging box of claim 9, wherein the second case comprises a top wall, a second side wall, and a separating wall, every two of the bottom wall, the first side wall, and mounting wall are connected to each other, an edge between the top wall and the separating wall is rotatably connected to an edge between the mounting wall and the first side wall, the top wall abuts against the first side wall when the second case is opened relative to the first case.

15. The packaging box of claim 14, wherein the top wall and the first side wall are magnetic and attracted to each other.

16. A packaging box, comprising:

a first case comprising a bottom wall, a first side wall, a mounting wall, and two first end walls, the bottom wall, the first side wall, and the mounting wall connected to each other, two first end walls connected to two ends of the bottom wall, the first side wall, and the mounting wall to enclose the first case; wherein the mounting wall is supported by the bottom wall and the first side wall and forms an acute angle with the bottom wall, the mounting wall comprises a receiving chamber configured to receive an electronic device and defining at least one through hole; the first case further comprises a sound chamber; each of the first end walls defines a plurality of sound holes; sound outputs from the electronic device are input to the sound chamber by the at least one through hole and output from the sound holes.

17. The packaging box of claim 16, wherein the receiving chamber is substantially cross-shaped, the electronic device is capable of being received in the receiving chamber in a horizontal position or a vertical position.

18. The packaging box of claim 17, wherein the receiving chamber defines a latching slot at one side of the receiving chamber, when the electronic device is received in the receiving chamber at the vertical position, the electronic device is latched by the latching slot.

19. The packaging box of claim 16, further comprising a supporter, wherein the mounting wall defines a mounting opening, the supporter comprises a bottom board corresponding to the mounting opening, a side board, and two opposite ends, the side board and the end portions surround edges of the bottom board to form the receiving chamber.

20. The packaging box of claim 19, wherein the supporter further comprises a plurality of fixing boards perpendicularly extending from ends of the side board and the two end portions opposite to the bottom board along a direction away from the receiving chamber, the fixing boards are fixed to an inner surface of the mounting wall.

* * * * *